United States Patent [19]

Yoshida et al.

[11] Patent Number: 4,800,850

[45] Date of Patent: Jan. 31, 1989

[54] HYDRAULIC CIRCUIT FOR A VALVE OPERATING MECHANISM FOR AN INTERNAL COMBUSTION ENGINE

[75] Inventors: Kazuo Yoshida, Tokyo; Koichi Fukuo, Saitam, both of Japan

[73] Assignee: Honda Giken Kogyo Kabushiki Kaisha, Tokyo, Japan

[21] Appl. No.: 137,757

[22] Filed: Dec. 24, 1987

[30] Foreign Application Priority Data

Dec. 27, 1986 [JP] Japan ..... 61-314029

[51] Int. Cl.[4] ..... F01L 1/18; F01L 1/26; F01M 9/10

[52] U.S. Cl. ..... 123/90.16; 123/90.34; 123/90.36

[58] Field of Search ..... 123/90.16, 90.17, 90.27, 123/90.33, 90.34, 90.36, 90.39, 90.44, 198 F

[56] References Cited

U.S. PATENT DOCUMENTS

| | | | |
|---|---|---|---|
| 3,628,513 | 12/1971 | Grosseau | 123/90.34 |
| 3,782,357 | 1/1974 | Kuhn et al. | 123/90.33 X |
| 4,441,465 | 4/1984 | Nakamura | 123/90.33 X |
| 4,535,732 | 8/1984 | Nakano et al. | 123/90.16 |
| 4,537,165 | 8/1985 | Honda et al. | 123/90.16 |
| 4,545,342 | 10/1985 | Nakano et al. | 123/198 F |
| 4,656,977 | 4/1987 | Nagahiro et al. | 123/90.16 |
| 4,709,667 | 12/1987 | Ichihara et al. | 123/90.34 |

*Primary Examiner*—Willis R. Wolfe
*Attorney, Agent, or Firm*—Lyon & Lyon

[57] ABSTRACT

A hydraulic circuit for a valve operating mechanism for an internal combustion engine which has a plurality of intake or exhaust valves normally urged in a valve closing direction, a plurality of adjacent rocker arms associated respectively with the intake or exhaust valves and pivotably supported on a rocker shaft. The rocker arms are pivotable by cams rotatable in synchronism with a crankshaft. A coupling mechanism is provided in the rocker arm selectively interconnecting and disconnecting adjacent rocker arms in response to oil pressure. A hydraulic circuit supplies oil pressure to the coupling means and an oil feed passage lubricates the cams. The hydraulic circuit and oil feed passage are connected in series to each other through a flow restriction and the hydraulic circuit includes a directional control valve for changing the direction of flow of lubricating oil supplied from an oil pump to cause the lubricating oil to flow from the oil feed passage to the hydraulic circuit during low-speed operation of the engine and to cause the lubricating oil to flow from the hydraulic circuit to the oil feed passage during high-speed operation of said engine to always provide the proper oil pressure levels in the oil feed passage and the hydraulic circuit.

8 Claims, 3 Drawing Sheets

HYDRAULIC CIRCUIT FOR A VALVE OPERATING MECHANISM FOR AN INTERNAL COMBUSTION ENGINE

The present invention relates to a hydraulic circuit for a valve operating mechanism for an internal combustion engine having a plurality of intake o exhaust valves openable through rocker arms by cams rotatable in synchronism with a cranshaft.

For controlling the output power of an internal combustion engine, it is known to vary the operation timing of the intake and exhaust valves in low- and high-speed operation modes of the engine for thereby increasing the efficiency of charging the air-fuel mixture into the combustion chamber over a wide engine operating range, for example as disclosed in U.S. Pat. Nos. 4,537,164, 4,537,165, 4,576,128, 4,545,342, 4,535,732, 4,587,936, 4,656,977 and 4,612,884 owned by the assignee of this application.

Such a valve operating mechanism includes a hydraulic circuit which is openable and closable by a solenoid-operating valve dependent on the rotational speed of the engine. When the hydraulic circuit is opened or closed, a piston disposed in one of rocker arms is moved to connect or disconnect that rocker arm to or from an adjacent rocker arm, so that the rocker arms can be operated in unison or separately to vary the operation timing of valves. It is highly important that the cams and the rocker arms held in slidable contact therewith be sufficiently lubricated from the standpoint of the performance and durability of the valve operating mechanism. One proposal has been to provide separate lubricating oil passages used respectively in low- and high-speed operation modes of the engine in order to lubricate the cams and the rocker arms according to the operating conditions of the engine.

A certain amount of lubricating oil under pressure which is retained in the engine is supplied under pressure to the hydraulic circuit and the lubricating oil passages by means of an oil pump. However, to supply and control the oil pressure separately for the respective lubricating oil passages makes the oil supply system complex and tends to fail to sufficiently supply the oil to the lubricating oil passages. Therefore, it is necessary to construct the hydraulic circuit and facilitate the control thereof economically in order to utilize the lubricating oil most effectively so that a sufficient and necessary supply of oil pressure is provided to reliably vary the operating timing of the valves and to sufficiently lubricate the cams and the rocker arms for varying the operation timing of the valves.

It is an object of the present invention to provide a hydraulic circuit for a valve operating mechanism for an internal combustion engine in which the operation timing of valves can be varied dependent on the rotational speed of the engine, the hydraulic circuit being capable of reliably varying the operation timing of the valves by effectively utilizing oil pressure supplied from the oil pump, being capable of supplying a necessary and sufficient amount of oil to the cams for varying the operation timing of the valves, and being easily controllable.

According to the present invention, the above object can be achieved by a hydraulic circuit for a valve operating mechanism for an internal combustion engine, having a low-speed cam having a shape suited for low-speed operation of the engine, a high-speed cam having a shape suited for high-speed operation of the engine, the low- and high-speed cams being integrally formed on a cam shaft rotatable in sychronism with a crankshaft, a first rocker arm held in slidable contact with said low-speed cam, a second rocker arm held in slidable contact with said high-speed cam, said first and second rocker arms being held in slidable contact with each other and swingably supported on a rocker shaft for relative angular displacement, a first oil feed passage for lubricating said low-speed cam, a second oil feed passage for lubricating said high-speed cam, coupling means for selectively interconnecting and disconnecting said first and second rocker arms under hydraulic pressure, and a hydraulic circuit for supplying hydraulic pressure to said coupling means, characterized in that said first and second oil feed passages are interconnected parallel to each other and connected in series to said hydraulic circuit through first restriction means, said hydraulic circuit includes directional control means for changing the direction of flow of lubricating oil supplied from the engine to cause the lubricating oil to flow from said oil feed passages to said hydraulic circuit upon low-speed operation of said engine and to cause the lubricating oil to flow from said hydraulic circuit to said oil feed passages upon high-speed operation of said engine, second and third restriction means disposed respectively at ends of said first and second oil feed passages near said oil pump, and fourth and fifth restriction means disposed respectively at ends of said first and second oil feed passages near said hydraulic circuit, said third restriction means having a larger degree of restriction than that of said second restriction means, and said fourth restriction means having a larger degree of restriction than that of said fifth restriction means.

By changing the direction of feed of lubricating oil supplied from the oil pump with a single controlling operation, the operation timing of the valves can be varied dependent on the rotational speed of the engine. Further, by this argument when the engine is in low-speed operation, the low-speed cam is mainly lubricated appropriately, and when the engine is in high-speed operation, the high-speed cam is mainly lubricated appropriately.

A preferred embodiment and a simplified embodiment of the present invention will hereinafter be described with reference to the accompanying drawings, wherein.

Figure 1:
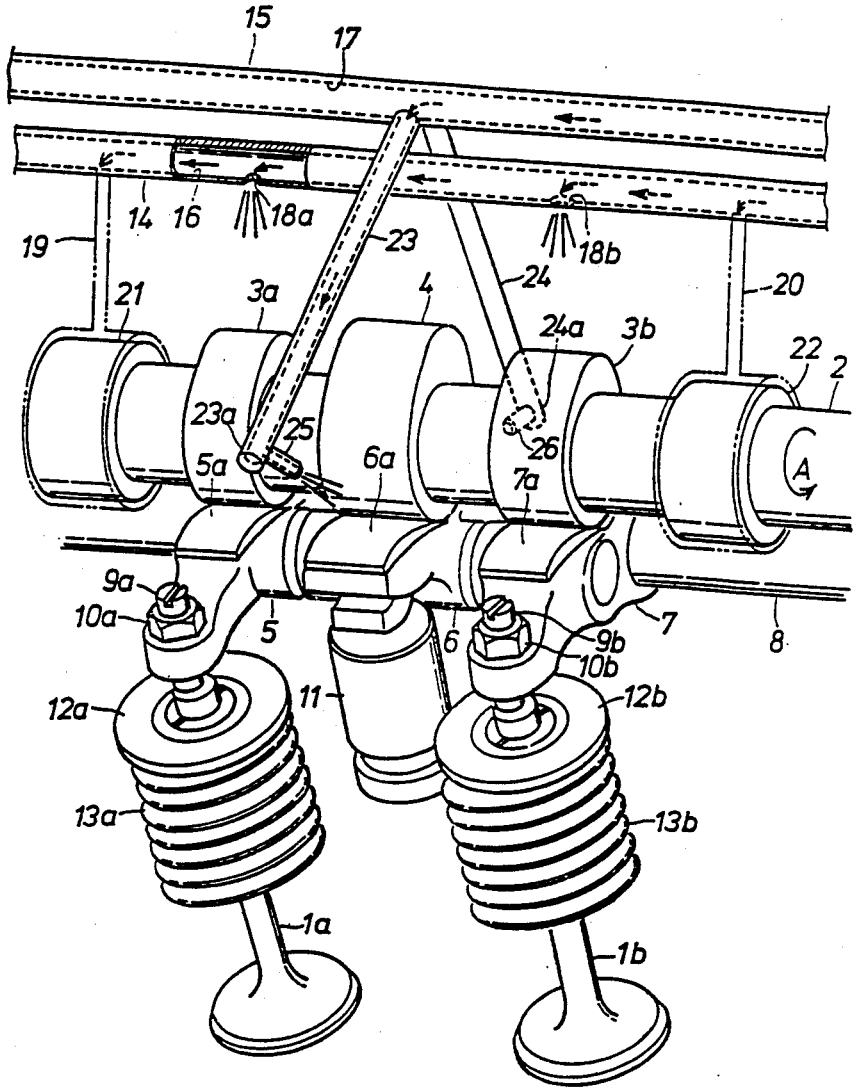
FIG. 1 is a perspective view of a valve operating mechanism for an internal combustion engine to which the hydraulic circuit of the present invention is applicable.

FIG. 1 shows a valve operating mechanism for an internal combustion engine, in which a hydraulic circuit of the present invention may be incorporated. The valve operating mechanism varies the operation timing of valves in low- and medium-speed ranges and a high-speed range of the engine. A pair of intake valves 1*a*, 1*b* mounted in an engine body (not shown) can be opened and closed by the coaction of a pair of low-speed cams 3*a*, 3*b* and a single high-speed cam 4 which are of egg-shaped cross section and are integrally formed on a camshaft 2. The camshaft 2 is synchronously rotatable at a speed ratio of ½ the speed of rotation of a crankshaft (not shown) and first through third rocker arms 5, 6, 7, serving as cam followers, are pivotable by engagement with the cams 3a, 3b, 4. The internal combustion engine also has a pair of exhaust valves (not shown) which may be opened and closed in the same manner as the intake valves 1a, 1b.

The first through third adjacent rocker arms 5, 6, 7 are pivotally supported on a rocker shaft 8 fixedly disposed parallel to and below a camshaft 2. The first and third rocker arms 5, 7 are basically identical in shape to each other and have base ends pivotally supported on valves 1a, 1b, respectively. The rocker arms 5, 7 have respective free ends through which tappet screws 9a, 9b are adjustably threaded in abutment against the upper ends of the intake valves 1a, 1b. The tappet screws 9a, 9b are prevented from being loosened by lock nuts 10a, 10b. Hydraulic lash adjusters may be substituted for tappet screws 9a, 9b.

The second rocker arm 6 is pivotally supported on the rocker shaft 8 between the first and third rocker arms 5, 7, and extends only a short distance toward a position between the intake valves 1a, 1b. The second rocker arm 6 has defined on its upper surface a cam slipper 67a held in slidable contact with the high-speed cam 4. A lost-motion spring device 11 has an upper end abutting against the lower end of the second rocker arm 6. The lost-motion spring device 11 houses a coil spring therein for normally urging the second rocker arm 6 upwardly to keep the high-speed cam 4 and the cam slipper 6a in slidable contact with each other at all times.

The camshaft 2 is rotatably mounted above the engine body. The camshaft 2 has the low-speed cams 3a, 3b of a cam profile having a relatively small lift suitable for low-speed operation of the engine. The low-speed cams 3a, 3b are integrally formed on the camshaft 2. The high-speed cam 4 is also integrally formed on the camshaft 2 and has a cam profile having a lift suitable for high-speed operation of the engine and having a larger angular extent than the low-speed cams 3a, 3b. The low-speed cams 3a, 3b have outer peripheral surfaces held in slidable contact with respective cam slippers 5a, 7a on the upper surfaces of the first and third rocker arms 5, 7. The first through third rocker arms 5, 6, 7 are angularly movable, dependent on the rotational speed of the engine, between a position in which they are pivotable in unison and a position in which they are relatively angularly movable by a coupling device mounted in holes defined centrally in the first through third rocker arms 5, 6, 7 parallel to the rocker shaft 8.

Retainers 12a, 12b are attached to upper portions of the intake valves 1a, 1b, respectively. Valve springs 13a, 13b are disposed between the retainers 12a, 12b and the engine body around the stems of the intake valves 1a, 1b for normally urging the intake valves 1a, 1b, respectively, in a valve closing direction.

Above the camshaft 2, there are disposed an oil feed pipe 14 for the low-speed cams 3a, 3b and an oil feed pipe 15 for the high-speed cam 4. The oil feed pipes 14, 15 have oil passages 16, 17 defined therein for supplying lubricating oil from the oil pump of the engine. The oil feed pipe 14 has ejector holes 18a, 18b defined in its peripheral wall and opening above the low-speed cams 3a, 3b, respectively. Lubricating oil supplied through the oil passage 16 is showered through the ejector holes 18a, 18b onto the low-speed cams 3a, 3b. The lubricating oil supplied via the oil passage 16 is also delivered to journals 21, 22 integrally formed on the camshaft 2 via passages 19, 20 joined to the oil feed pipe 14 for lubricating the journals 21, 22.

The other oil feed pipe 15 has two branch pipes 23, 24 connected to it which extend perpendicular to the axis of the oil feed pipe 15. The branch pipes 23, 24 have free ends 23a, 24a positioned one on each side of the high-speed cam 4 and facing the mutually sliding surfaces of the cam 4 and the camslipper 6a. A nozzle 25 is attached to the free end 23a of the branch pipe 23 and the nozzle 25 opens toward the mutually sliding surfaces of the cam 4 and the cam slipper 6a. The nozzle 25 ejects lubricating oil from a front side of the cam 4 in the same direction as the direction, indicated by the arrow A, in which the cam 4 rotates. Likewise, a nozzle 26 is attached to the free end 24a of the branch pipe 24 and the nozzle 26 opens toward the mutually sliding surfaces of the cam 4 and the cam slipper 6a from the other side thereof. The nozzle 26 ejects lubricating oil from a rear side of the cam 4 in the opposite direction to the direction A of rotation of the cam 4.

Figure 2:
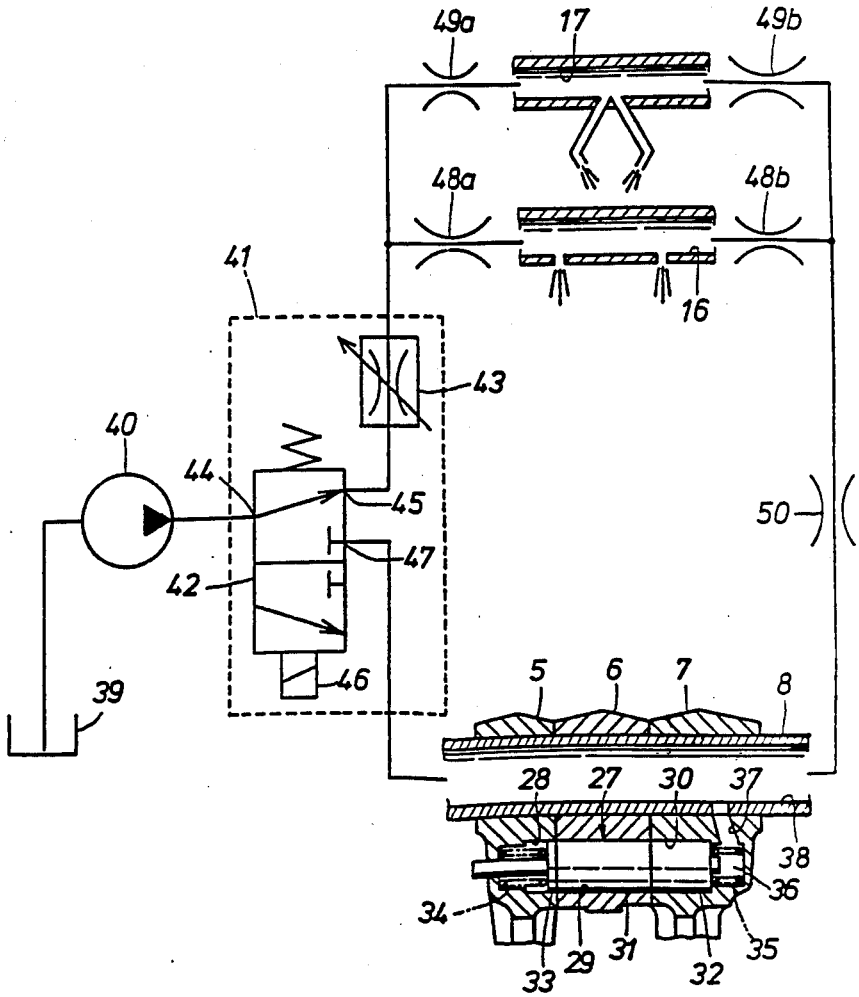
FIG. 2 is a diagram of the preferred embodiment of the hydraulic circuit of the present invention.

As illustrated in FIG. 2, the first through third rocker arms 5 through 7 house a coupling device 27 for interconnecting and disconnecting the rocker arms dependent on the rotational speed of the engine. The coupling device 27 comprises pistons 31, 32 and a stopper 33 which are slidabley housed in guide holes 28 through 33 defined respectively in the rocker arms 5 through 7, and coil springs 34, 35 for biasing the stopper 33 and the piston 32, respectively. A hydraulic chamber 36 is defined in the bottom of the guide hole 30 in the third rocker arm 7 and is in communication at all times with an oil passage 38 defined in the rocker shaft 8 through a passage 37.

When a prescribed oil pressure is supplied from the engine through the oil passage 38 into the hydraulic chamber 36, the piston 31, 32 are moved respectively into the guide holes 28, 29 in the first and second rocker arms 5, 6 against the bias of the coil spring 34, for thereby interconnecting the first through third rocker arms 5 through 7. When the oil pressure is released from the hydraulic chamber 36, the pistons 31, 32 are pushed back into the guide holes 29, 30, respectively, in the second and third rocker arms 29, 30 under the resiliency of the coil spring 34, whereupon the rocker arms 5 through 7 are separated for relative angular displacement. The operation timing of the valves is varied for low- and medium-speed operation and for high-speed operation of the engine.

As shown in FIG. 2, lubricating oil stored in an oil tank 39 is fed under pressure to a flow-rate regulating directional control valve 41 by an oil pump 40. The flow-rate regulating directional control valve 41 comprises a spool valve 42 and a variable orifice 43. The spool valve 42 normally holds a first port 44 serving as an oil pressure inlet and a second port 45 in communication with each other. When the solenoid 46 is energized, the spool valve 42 is shifted to communicate the first port 44 with a third port 47. The variable orifice 43 is connected downstream of the second port 45 and communicates with the first oil passage 16 which lubricates the low-speed cams and the second oil passage 17 which lubricates the high-speed cam. The third port 47 communicates with the oil passage 38 in the rocker shaft 8.

The first oil passage 16 and the second oil passage 17 extend parallel to each other. Orifices 48a, 48b, 49a, 49b of different orifice diameters are connected to the opposite ends of the first and second oil passages 16, 17. The first and second oil passages 16, 17 and the oil passage 38 are connected in series to each other through another orifice 50.

The hydraulic circuit of the above structure operates as follows. During low- and medium-speed operation of the engine, the first and second ports 44, 45 of the spool valve 42 are held in communication with each other. Therefore, lubricating oil supplied under pressure from the oil pump 40 flows through the variable orifice 43 which regulates the flow rate of the oil, and then flows into the first and second oil passages 16, 17 to lubricate the cams and cam slippers. The oil flowing out of the first and second oil passages 16, 17 is then regulated in its flow rate by the orifice 50 and introduced into the oil passage 38. The orifices 48*a*, 49*a* disposed upstream of the first and second oil passages 16, 17 in the direction of flow of the lubricating oil at this time have their orifice diameters or orifice areas selected such that the orifice diameter of the orifice 48*a* connected to the first oil passage 16 is larger than the orifice diameter of the orifice 49*a* connected to the second oil passage 17. Therefore, more lubricating oil flows through the first oil passage 16 than through the second oil passage 17, so that the low-speed cams 3*a*, 3*b* are lubricated with more iubricating oil.

As the lubricating oil supplied from the engine passes successively through the variable orifice 43, the orifices 48*a*, 48*b*, 49*a*, 49*b*, and the orifice 50, the pressure of the lubricating oil is successively lowered, and the oil pressure in the oil passage 38 is low enough to keep the coupling device 27 inactivated. The rocker arms 5 through 7 are lubricated by the lubricating oil supplied to the oil passage 38 at this time.

During high-speed operation of the engine, the solenoid 46 is energized to bring the first port 4 into communication with the third port 47, and the oil pressure from the oil pump 40 is directly supplied to the oil passage 38. The coupling device 27 is now actuated to connect the first through third rocker arms 5 through 7 together for thereby varying the operation timing of the valves. The lubricating oil flowing out of the oil passage 38 is regulated in its flow rate by the orifice 50 and then delivered to the first and second oil passages 16, 17. At this time, the lubricating oil flows through the first and second oil passages 16, 17 in the opposite direction to the direction in which it flows in the low- and medium-speed operation of the engine. The orifices 48*b*, 49*b* disposed upstream of the first and second oil passages 16, 17 in the direction of flow of the lubricating oil at this time have their orifice diameter of the orifice 49*b* connected to the oil passage 17 is larger than the orifice diameter of the orifice 48*b* connected to the first oil passage 16. Therefore, more lubricating oil flows through the second oil passage 17 than through the first oil passage 16, so that the high-speed cam 4 is lubricated with more lubricating oil.

With the preferred embodiment of the present invention, as described above the oil passage for lubricating the low-speed cams and the oil passage for lubricating the high-speed cam extend parallel to each other, and these oil passages and the oil passage for supplying oil pressure to the coupling device are connected in series to each other through an orifice. The direction of flow of lubricating oil supplied from the engine is changed by a spool valve. The cams are supplied with a proper amount of lubricating oil and the coupling device is operated simultaneously through a single control operation. The orifices of different orifice diameters are connected to the opposite ends of the oil passages for lubricating the low- and high-speed cams, so that one or the other of the low- and high-speed cams can selectively be lubricated with more lubricating oil dependent on the direction of flow of the lubricating oil. The hydraulic circuit is simple in arrangement, and the lubricating oil supplied from the engine can be utilized most effectively for reliably varying the operation timing of the valves. The low- and high-speed cams can selectively be supplied with a neccessary and sufficient amount of lubricating oil dependent on the operating conditions of the engine.

Figure 3:
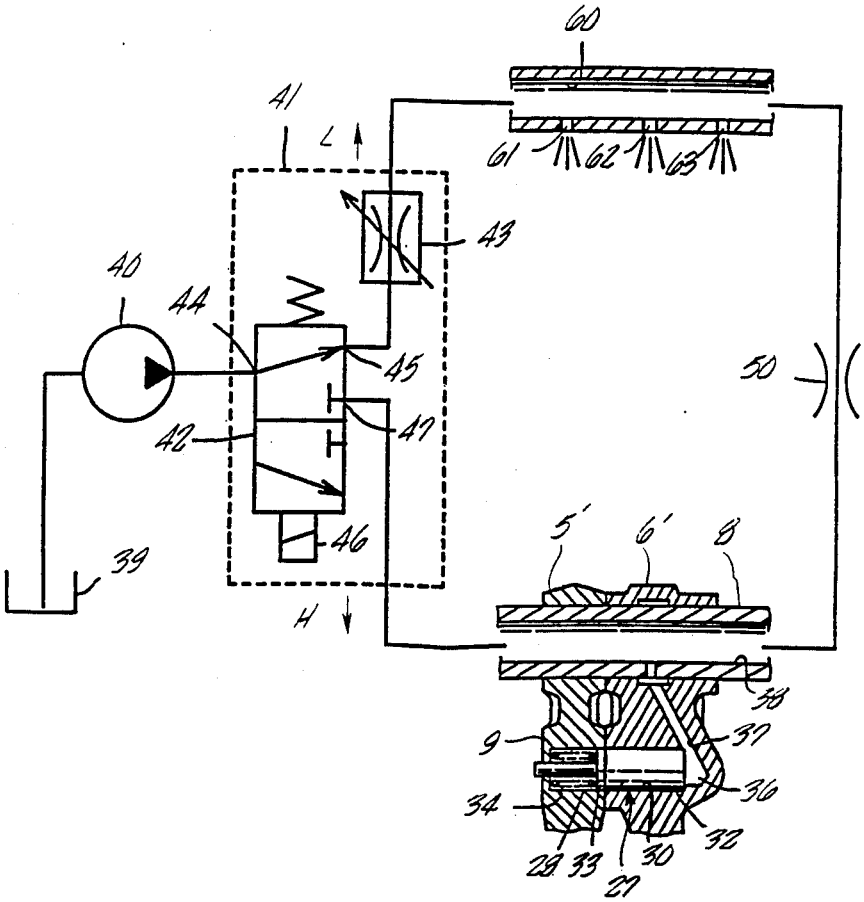
FIG. 3 is a diagram of a simplified embodiment of the hydraulic circuit of the present invention.

Referring now to the simplified embodiment of this invention shown in FIG. 3, only two rockers arms 5′ and 6′ are provided rather than the three rocker arms 5, 6 and 7 of the first embodiment. The intake or exhaust (not shown) to be operated by these rocker arms 5′, 6′ may be engaged and moved by either one or both of the rocker arms and cams (not shown) can be arranged to engage one or both of rockers arms 5′, 6′, as is known from the U.S. Patents referred to at the start of this specification. The coupling device 27′ includes a piston 32 slidably mounted in a guide hole 30 in rocker arm 6′ and a stopper 33 slidably mounted in a guide hole 28 in rocker arm 5′. Upon the application of high oil pressure through oil passages 38 and 37 to chamber 36, the piston 32 will move into guide hole 28 to connect the rocker arms 5′ and 6′ for high-speed engine operation.

The flow-rate regulating and directional control valve 41 is constructed and functions in the same manner as previously described to provide low pressure oil to the hydraulic circuit in the direction of arrow L during lo--speed engine operation and in the direction of arrow H during high-speed engine operation by de-energizing or energizing, respectively, the solenoid 4*b*. When the oil flow is in the direction L, the low pressure oil is supplied from variable orifice 43 to oil feed passage 60 where a substantial proportion is ejected from holes 61, 62, 63 to lubricate the cams or journals, such as accomplished by the two oil passages 16 and 17 in the first embodiment. The remaining oil then flows through the orifice 50 into oil passage 8 for lubricating the journals of the rocker arms 5′ and 6′ but the oil pressure is too low to actuate the coupling device 27′. When the oil flow is in the direction H, the high pressure oil actuates the coupling device 27′ to connect the rocker arms 5′ and 6′ and then flows through orifice 50 to oil passage 60 where the oil pressure is sufficient for lubrication by ejecting from holes 61, 62 and 63 but not excessive so as to waste the oil.

We claim:

1. A hydraulic circuit for a valve operating mechanism for an internal combustion engine, having a plurality of intake or exhaust valves normally urged in a valve closing direction, a plurality of adjacent rocker arms associated respectively with said intake or exhaust valves and pivotably supported on a rocker shaft, said rocker arms being pivotable by cams rotatable in synchronism with a crankshaft, coupling means for selectively interconnecting and disconnecting said adjacent rocker arms under oil pressure to said coupling means, and an oil feed passage for lubricating said cams, an improvement comprising, said hydraulic circuit and said oil feed passage being connected in series to each other through restriction means, said hydraulic circuit including directional control means for changing the direction of flow of lubricating oil supplied from an oil pump to cause the lubricating oil to flow from said oil feed passage to said hydraulic circuit during low-speed operation of said engine and to cause the lubricating oil to flow from said hydraulic circuit to said oil feed passage during high-speed operation of said engine.

2. A hydraulic circuit according to claim 1, wherein a second restriction means is provided between said oil pump and said oil feed passage for reducing the pressure and rate of oil flow to said oil feed passage during said low-speed operation of said engine.

3. A hydraulic circuit according to claim 2, wherein said second restriction means is variable.

4. A hydraulic circuit according to claim 1, wherein said oil feed passage is comprised of two separate oil passages connected in parallel.

5. A hydraulic circuit according to claim 4, wherein each of said two separate oil passages has ejector holes for ejecting lubricating oil on cams, and one of said two separate oil passages ejecting oil one set of cams and the other of said two separate oil passages ejecting oil on a different set of cams.

6. A hydraulic circuit according to claim 4, wherein separate restriction means are provided on each end of each said two separate oil passages for individually controlling the rate of oil flow in each separate oil passage and in each direction of oil flow therethrough.

7. A hydraulic circuit for a valve operating mechanism for an internal combustion engine, having a low-speed cam having a shape suited for low-speed operation of the engine, a high-speed cam having a shape suited for high-speed operation of the engine, the low- and high-speed cams being intergrally formed on a cam shaft rotatable in synchronism with a crankshaft, a first rocker arm held in slidable contact with said low-speed cam, a second rocker arm held in slidable contact with said high-speed cam, said first and second rocker arms being held in slidable contact with each other and pivotably supported on a rocker shaft for relative angular displacement, a first oil feed passage for lubricating said low-speed cam, a second oil feed passage for lubricating said high-speed cam, coupling means for selectively interconnecting and disconnecting said first and second rocker arms under hydraulic pressure, and a hydraulic circuit for supplying hydraulic pressure to said coupling means, an improvement comprising, said first and second oil feed passage being interconnected parallel to each other and connected in series to said hydraulic circuit through first restriction means, said hydraulic circuit including directional control means for changing the direction of flow of lubricating oil supplied from an oil pump to cause the lubricating oil to flow from said oil feed passages to said hydraulic circuit during low-speed operation of said engine and to cause the lubricating oil to flow from said hydraulic circuit to said oil feed passages during high-speed operation of said engine, second and third restriction means disposed respectively at ends of said first and second oil feed passages near said oil pump, and fourth and fifth restriction means disposed respectively at ends of said first and second oil feed passages near said hydraulic circuit.

8. A hydraulic circuit according to claim 7, wherein said third restriction means has a larger degree of restriction than that of said second restriction means, and said fourth restriction means has a larger degree of restriction than that of said restriction means.

* * * * *